US006644367B1

(12) United States Patent
Savage et al.

(10) Patent No.: US 6,644,367 B1
(45) Date of Patent: Nov. 11, 2003

(54) CONNECTOR ASSEMBLY FOR FLUID FLOW WITH ROTARY MOTION FOR CONNECTION AND DISCONNECTION

(75) Inventors: Chester Savage, Irvine, CA (US); Mark Anderson, Mitcham (AU); Silvia Sandvoss, Murrieta, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/048,135

(22) PCT Filed: Jul. 23, 1999

(86) PCT No.: PCT/US99/16640

§ 371 (c)(1),
(2), (4) Date: Jul. 11, 2002

(87) PCT Pub. No.: WO01/07321

PCT Pub. Date: Feb. 1, 2001

(51) Int. Cl.[7] ..... B65B 1/04

(52) U.S. Cl. ..... 141/383; 141/346; 141/351; 137/614.04

(58) Field of Search ..... 141/383, 98, 114, 141/346, 351, 347, 348, 349, 350, 352–362; 222/105; 137/614.04

(56) References Cited

U.S. PATENT DOCUMENTS 4,375,864 A 3/1983 Savage
5,560,405 A 10/1996 Harris et al.
5,816,298 A 10/1998 Stricklin et al.
5,996,653 A 12/1999 Piccinino, Jr.

FOREIGN PATENT DOCUMENTS

EP 0 778 142 B1 6/1997
WO WO 98/29314 A 8/1997
WO WO 99/05446 A 2/1999

*Primary Examiner*—Steven O. Douglas
(74) *Attorney, Agent, or Firm*—James W. Inskeep; Inskeep Intellectual Property Group, Inc.

(57) ABSTRACT

A two-part connector structure (22, 32) includes a male connector part (32) and a female connector part (22) which are mutually engageable to open fluid communication between the connector parts (22, 32). For example, the connector parts (22, 32) may be used to establish fluid communication between a container (12) and a conduit (14). The connector parts (22, 32) are disengageable from one another to discontinue fluid communication between them, and also to close communication between ambient and each of the container and the conduit. The male connector part (32) includes a mounting structure (32*a*) for supporting on the female connector part (22), and also includes a guide structure (44) effective to guide a male portion (36) of the male connector part (32) into engagement with the female connector part (22). A handnut (34) of the male connector part (32), and is effective upon manual rotation to cause axial relative movement of the male probe portion (36) into or out of engagement with the female connector part (32). This invention provides a connector structure (22, 32) with considerably lowered manual engagement and disengagement forces, along with increased convenience and ease of use.

13 Claims, 4 Drawing Sheets

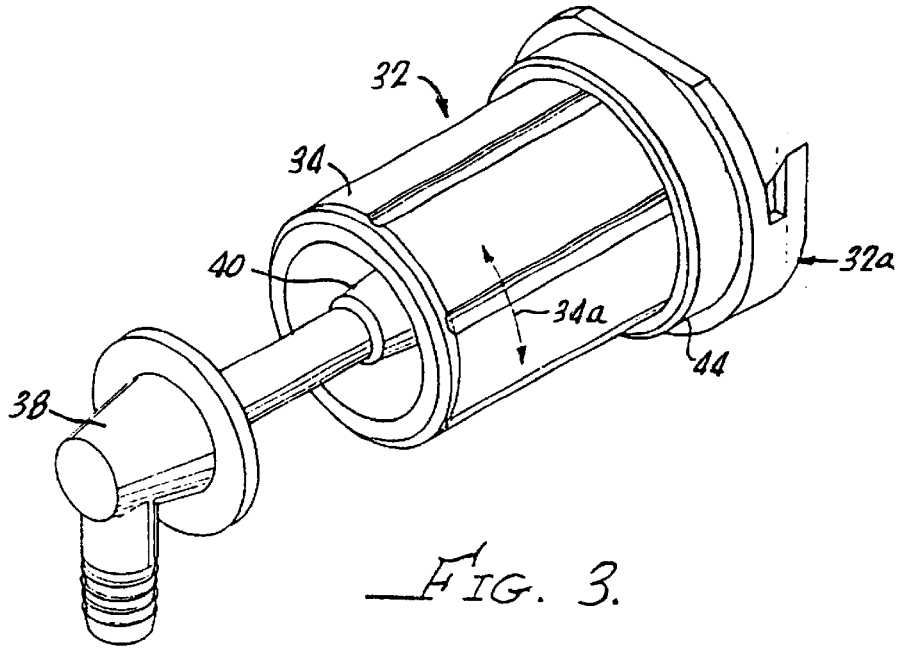
FIG. 3.
FIG. 5.
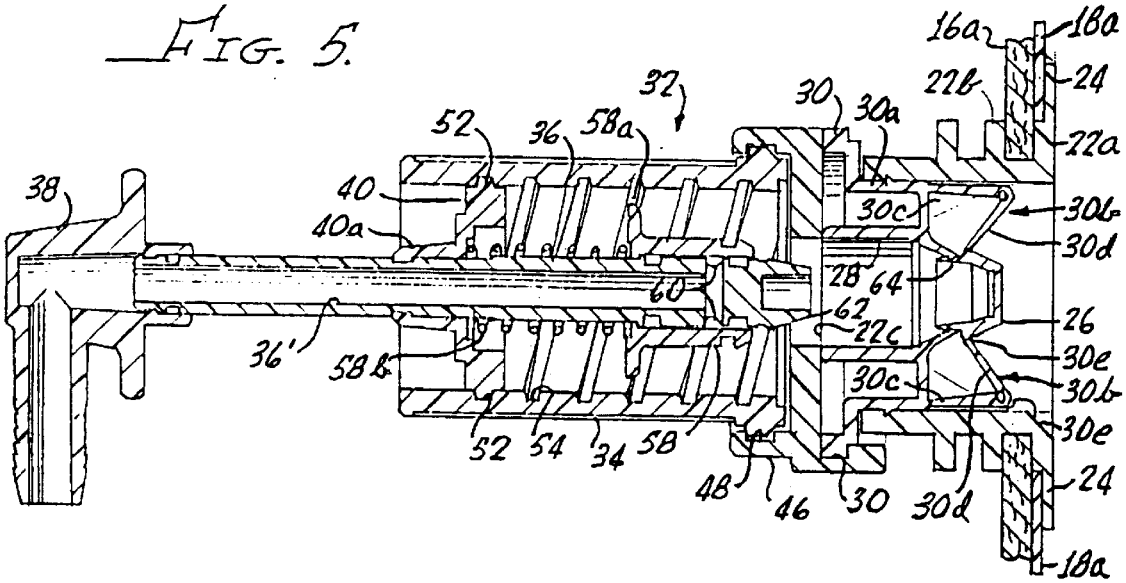

CONNECTOR ASSEMBLY FOR FLUID FLOW WITH ROTARY MOTION FOR CONNECTION AND DISCONNECTION

BACKGROUND OF THE INVENTION

1. Field of the Invention

The present invention is in the field of connector assemblies used to connect and disconnect fluid flows. These connector assemblies are generally characterized as being of the "dry break" type. More particularly, the present invention relates to a connector assembly which includes a first (or male) part, and a second (or female) part. When the male and female parts are connected to one another they effect fluid-flow communication between the connector parts. When the connector parts are disconnected they mutually reseal so that fluid is not lost from either the male or the female connector part Further, the present invention relates to such connectors which additionally have a guide structure removably supporting on one of the connector parts, and guiding the other connector part reciprocally for engagement and disengagement with the one connector part.

Still further the present invention relates to such connectors that utilize a rotary handnut in order to effect the connecting and disconnecting of the connector parts, thus providing for a reduced level of manual force necessary to utilize the connector.

2. Related Technology

A conventional connector is known from WIPO application WO99/05446, published Feb. 4, 1999. This application is believed to disclose a connector in which a male and a female part cooperate when engaged with one another to effect fluid flow between the parts. When the connector parts are disconnected from one another, one of the parts (the female part) may reseal so that fluid is not lost from the female connector part. Embodiments of this connector require a manual application of axial force in order to effect connection or disconnection of the connector parts. Other embodiments of this connector provide for a relatively rotational part to be rotated manually relative to a base portion carrying the female connector part in order to effect connection and disconnection of the connector parts. These embodiments do not provide, however, for the male part to reseal when the connector parts are disconnected. Thus, should the male part be withdrawn from the base portion of the female connector part, there will be loss of fluid from the male connector part.

A further conventional connector structure is known in accord with U.S. Pat. No. 4,421,146 (the '146 patent), issued Dec. 20, 1983 to Curtis J. Bond, et al. A connector structure according to the '146 patent includes a tubular spout attached to and in fluid communication with a fluid filled vessel, such as a bag held within a cardboard box. This spout portion includes a plug member which is axially moveable between a first position closing fluid communication between the vessel and an outer portion of the spout member, and a second position opening this fluid communication. In the second position of the plug member a pair of lateral openings at an inner portion of the plug member are moved inwardly of the spout to permit fluid communication between the vessel and the outer portion of the spout.

A service member (i.e., the male connector part) of the Bond '146 patent is carried in a guide structure which clamps to the spout and guides the service member for axial sliding engagement into sealing relation with the spout. The service member provides communication with a conduit, and includes a valve member closing communication between the conduit and ambient when the service member is disconnected from the spout. The service member as it engages the spout is also engageable with the plug member to move it between its two positions, and engagement between the service member and plug member opens the valve in the service member. Thus, when the service member is engaged into the spout, communication between the vessel and the conduit is established. Further, it is seen that the plug member of the Bond '146 patent carries an axial projection which contacts the valve member of the service member (the male connector part), and opens this valve member.

When the service member and spout member of the connector according to the Bond '146 patent are axially disengaged from one another, a small volume of fluid is retained outwardly of the valve member and spout. This retention volume of fluid is small because the service member defines a domed end surface, and the plug member has a matching contoured end wall closely fitting to the valve member. The lateral ports of the plug member are themselves of small volume, and the passage leading to the plug member is small and is mostly filled by the plug valve member itself when this member is moved to its closed position.

Users of fittings such as that illustrated in the Bond '146 patent have a tendency to simply push on the service member or its attached hoses or conduits in order to effect its engagement with the spout. This forceful pushing by the user may transfer too much force to the container so that the spout is dislodged from its desired location on the container connector. Further, the service member of the Bond '146 patent cannot be conveniently opened for cleaning, inspection, or replacement of the sealing member therein. It is true that the service member can be disassembled manually, but this service member contains many parts, and after the service member has been used to convey a food product, its disassembly is a messy job. Consequently, these conventional service members are sometimes discarded when a simple cleaning or replacement of an O-ring seal would allow their continued use. Again, however, because the service member according to the Bond '146 patent cannot be conveniently cleaned or fitted with a new O-ring, many users simply throw the fitting away and purchase a new one.

Another conventional connector, which may be considered to be of hermaphrodite configuration, is known from European patent application No. 0 294 095 A1, published Dec. 7, 1988 (the '095 application). According to the '095 application, a "male" and "female" connector parts are brought into alignment and juxtaposition by a yoke carried on a guide housing. The male connector part is configured as a tubular member which is axially movable by a handle on the guide housing to engage with an annular valve member carried in the female connector part. When the male and female connector parts are coupled with one another (i.e., by extension of the male connector part relative to the guide housing and into the female connector part), an inner liquid extraction flow path is separated from an outer air-entrance (or pressurized gas delivery) flow path by the annular valve member of the female connector. In the coupled condition of the male and female connectors, the annular valve member of the female connector part also serves as a sealing member. A version of this connector is also known in which the male connector part carries a spring-loaded internal disk valve member which closes the liquid extraction flow path of the male connector part when the male and female connector parts are not coupled with one another.

Further, in a conventional connector known in accord with U.S. Pat. No. 5,816,298, issued Oct. 6, 1998, and assigned to the same assignee at the present application. In this connector structure two hands were required to push the sleeve of the male part up into the female part in order to disengage the plug of the female fitting and allow fluid flow through the male sleeve. In the '298 patent the connector utilizes a pair of opposite ears, which protrude from oppose sides of the guide portion of the male connector member. The purpose of these ears is to allow a user of the connector to manually push the sleeve of the male connector part axially into the female connector part in order open both connector parts and allow fluid flow through the engaged connector parts.

SUMMARY OF THE INVENTION

In view of the deficiencies of the related technology, a need exists for a connector assembly which provides for manual ease of use, and a general reduction in the amount of manual force required of a user when effecting engagement and disengagement of the connector parts.

Additionally, a need can be seen to exist in view of the deficiencies of the related technology for such a connector assembly which allows the male connector part to be opened for inspection, cleaning, and service without the male connector part being attached to a female connector part.

Accordingly, the present invention in accord with one aspect provides a male connector portion for use with a female connector portion to form a fluid-flow connection, each of the male connector portion and the female connector portion defining a respective axially extending fluid flow path and being removably engageable with one another to communicate the respective fluid flow paths, the female connector portion including an integral valve element having a closed first position closing the fluid flow path of the female connector portion and an open second position axially displaced from the first position, the valve element moving to the second position in response to engagement together of the connector portions to communicate the fluid flow paths with one another and remaining integrally connected with the female connector portion in both the first and the second positions thereof, the male connector portion comprising: a male probe portion reciprocable axially relative to a remainder of the male connector portion; a guide portion including support means for supportingly and releasably engaging onto the female connector portion, the guide portion including structure for carrying a rotatable actuator member relative rotation of which effects reciprocation of the male probe portion between first and second positions to respectively connect and disconnect of the male probe portion into and from the female connector portion; and the actuator member and the male probe portion defining cooperating structure for reciprocating the male probe portion axially between the first position and the second position in response to relative rotation of the actuator member, the male probe portion in response to reciprocation to its second position moving the valve member to its respective second position.

An advantage of the present invention is that the plug member of the female connector part cannot be disconnected from this female connector part. Thus, the plug member cannot be lost inside of a vessel or container to which the female connector part is mounted.

Further, an advantage of the present invention resides in the ability to disassemble the male connector part for inspection and cleaning. The male connector part can be extended for inspection even when it is not connected to a female connector part, and than can be fully disassembled for cleaning and repair, such as the replacement of O-ring type seals, if necessary.

These and additional objects and advantages of the present invention will be apparent from a reading of the following detailed description of an exemplary preferred embodiment of the invention taken in conjunction with the appended drawing Figures, which are briefly described immediately below.

BRIEF DESCRIPTION OF THE DRAWING FIGURES

FIG. 1 provides a perspective and somewhat schematic view of a fluid dispensing system with a portion of a cardboard box part broken away for clarity of illustration, and including a fluid-filled bag connecting to a fluid conduit via a connector assembly embodying the invention;

FIG. 2 provides a fragmentary perspective view, partially in cross section, of a female connector part carried on the container seen in FIG. 1;

FIG. 3 is a perspective view of the male connector part seen in FIG. 1, and is presented at an enlarged size for clarity of illustration;

FIG. 4 provides an exploded perspective view of the male connector part embodying the present invention;

FIG. 5 is a longitudinal cross sectional view of the male connector mounted to but not engaged with a female connector member, with the female connector member in its closed position;

FIG. 6 provides a fragmentary cross sectional view showing a male connector part mounted to and engaged with the female connector part so that both the male and female connector parts are opened, and fluid may flow between these connector parts;

DETAILED DESCRIPTION OF TWO EMBODIMENTS OF THE INVENTION

Figure 1:
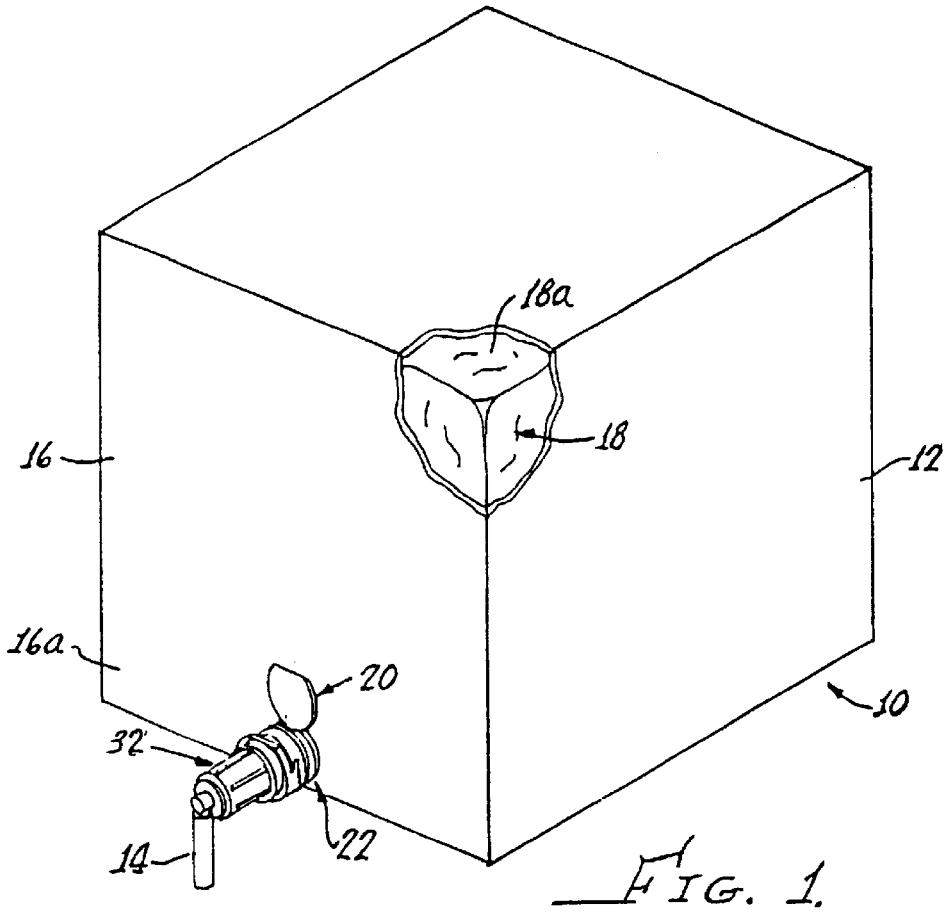

A fluid dispensing system 10 of bag-in-box configuration is schematically depicted in FIG. 1. In general, this fluid dispensing system 10 includes a liquid-filled vessel or container 12, which may be connected to a dispensing pump (not shown) by a conduit 14. The container 12 may be of any desired construction, but the illustrated container is of the bag-in-box configuration with an outer shape-retaining box 16, which in the illustrated embodiment is formed of corrugated cardboard, and an inner flexible bag 18 (only a portion of which is visible in FIG. 1). Preferably, the bag 18 is fabricated of plastic sheet.

Figure 2:
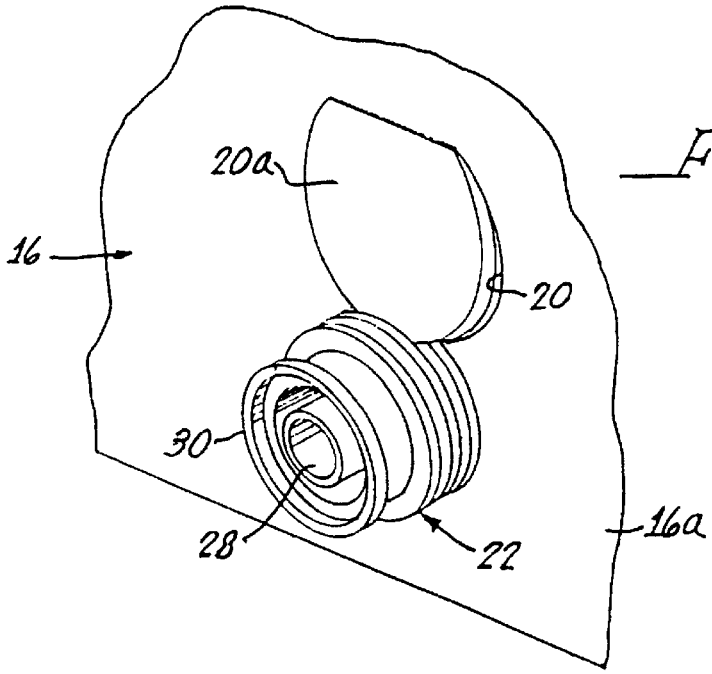

Viewing FIGS. 1–6 in conjunction with one another, and viewing first FIG. 2 in particular, this Figure illustrates that a side wall 16*a* of the box 16 defines a keyhole-shaped cutout 20. This cutout 20 allows a female connector part 22, which is mounted to and communicates with the interior space of bag 18, to be extended partially outwardly through this cutout 20. Once the female connector part 22 is extended from within the box 16 partially outwardly through the cutout 20, it is there retained in a lower extent of the cutout 20 by the cooperation of a pair of axially spaced apart flanges 22*a* and 22*b* on the connector part 22 (best seen in FIG. 5). These spaced apart flanges 22*a* and 22*b* capture between them a portion of the wall 16*a* of box 16 at each side and around the bottom of cutout 20. The female connector part 22 is itself trapped in the lower extent of the cutout 20 by a keyhole-shaped portion 20*a* of the box wall 16*a* (viewing FIGS. 1 and 2). As is also best seen in FIGS. 1 and 2, the keyhole-shaped portion 20*a* is hingably attached at its upper extent to the wall 16*a* of the box 16. Consequently, the keyhole-shaped portion 20*a* may be manually hinged out of the way while the female connector part 22 is introduced into and is slid downwardly along cutout 20 into the lower extent of this cutout. After the female connector part 22 is in the lower extent of cutout 20, manual return of the keyhole-shaped portion 20*a* to the position seen in FIGS. 1 and 2 retains the female connector part 22 in the cutout 20 of the wall 16*a*.

It is seen further in FIG. 5 that the female connector part 22 has an inner flange 24 to which the wall 18*a* of bag 18 is sealingly secured (i.e., at an opening of this bag). Consequently, the female connector part 22 provides access to the interior volume of the bag 18 and container 12. That is, the liquid contents of the bag 18 communicate with the female connector part 22, and may flow outwardly via this connector part. It will be understood that the female connector part 22 includes a movable plug member 26 (seen in FIG. 5). This plug member 26 is seen in FIG. 5 removably closing a flow path or passage 28 through the female connector part 22. At its distal end (i.e., furthest from the box 16) the female connector part 22 includes a radially outwardly extending mounting flange 30. This mounting flange 30 provides for mounting of a male connector part 32 to the female connector part 22. That is, as will be seen, the male connector part 32 is moved laterally relative to the female connector part 32 so that a grooved stirrup 32*a* of the male connector part catches and traps the flange 30. Thus, the male and female connector parts mutually hold one another in axial alignment, and relative axial motion of these connector parts is prevented. This mode of mounting a male connector part to a female connector part will be generally familiar from the '298 patent referenced above. Thus, it will be understood that the illustrated and described mode of mounting of the male connector part to the female connector part is exemplary only, and is not limiting of the present invention.

FIGS. 3, 4, 5, and 6 in conjunction with one another illustrate one embodiment of a male connector part 32 embodying the present invention, which is also seen in FIG. 1 mounted to the female connector part 22 in order to connect the conduit 14 in fluid flow communication with the liquid within the bag 18 of container 12. In FIG. 3, the male connector part 32 is seen from a perspective similar to that of FIG. 1, which provides a good view of a rotational manual actuator or handnut portion 34 of this male connector part. As is represented by the double-headed rotation arrow 34*a* adjacent to the handnut 34 in FIG. 3, this handnut portion 34 is manually rotational relative to the remainder of the male connector part 32, and is effective (as will be explained) to insert and withdraw the forward end portion of a male probe part 36 (best seen in FIGS. 5 and 6) into and from the female connector part 22, dependent upon the direction of manual rotation of the handnut portion 34.

Figure 4:
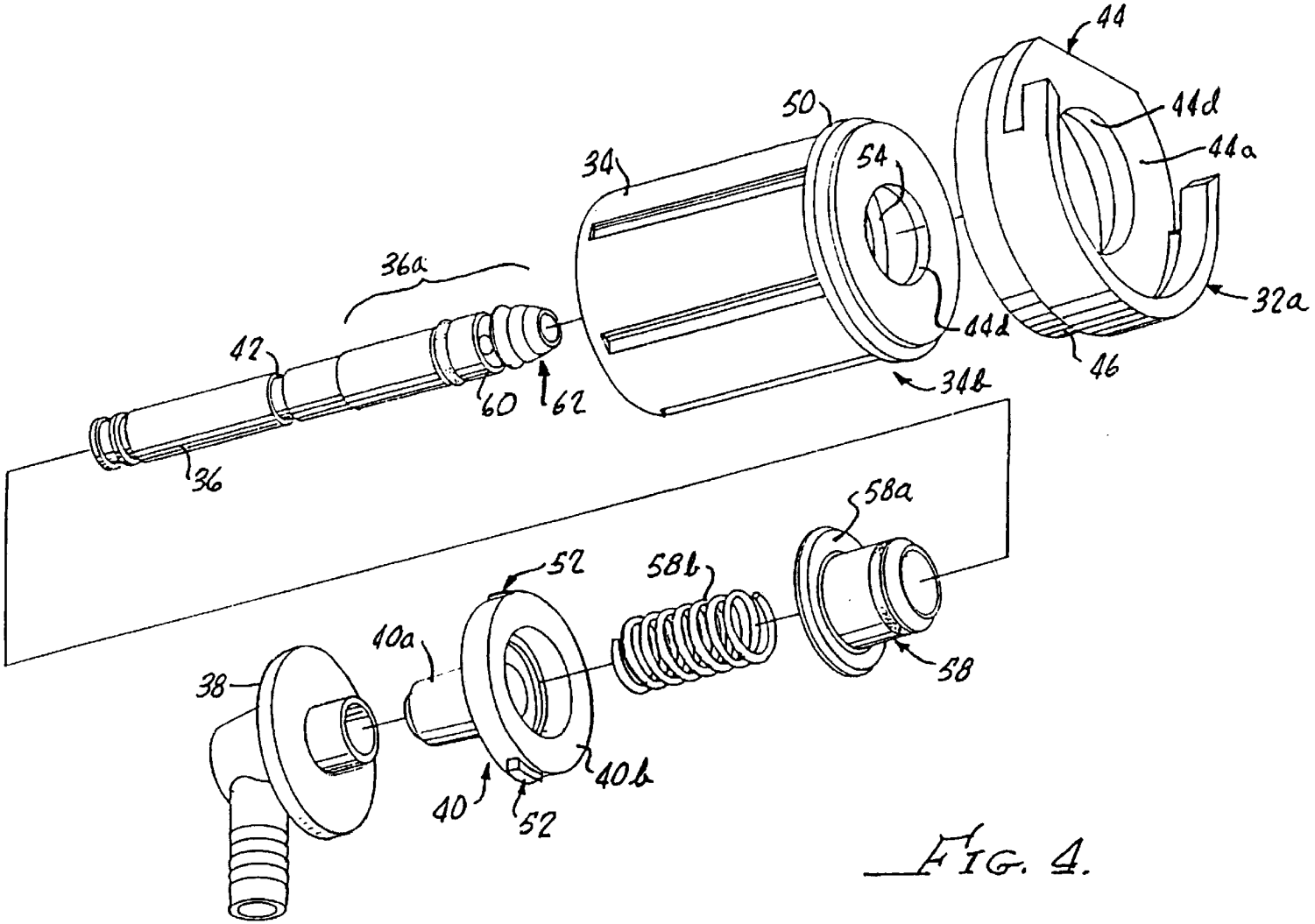
Figure 6:
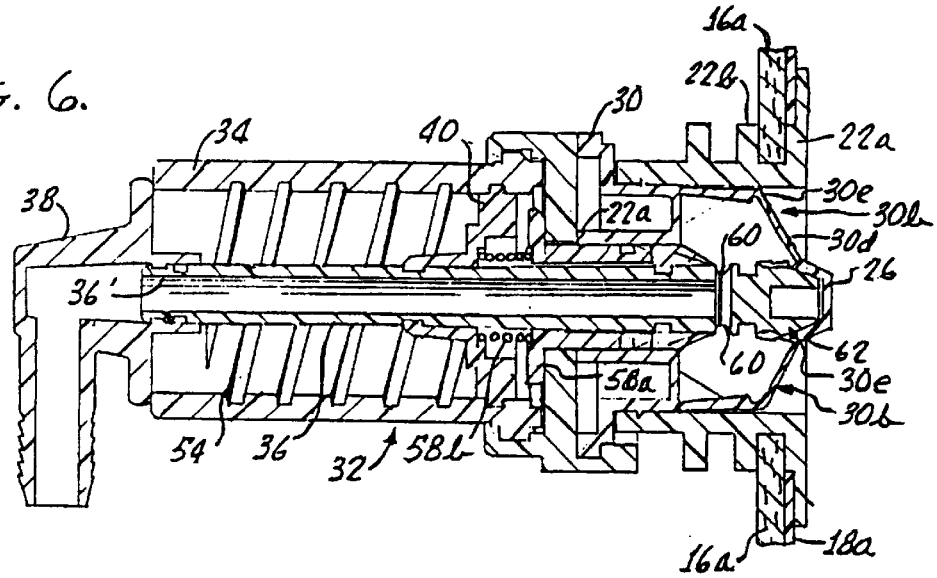

As is seen in FIGS. 5 and 6, the male probe part 36 defines a flow passage indicated with numeral 36'. Also seen in FIG. 3 is an elbow and hose barb member 38 of the male probe portion 36, and a fragmentary portion of a nut member 40, having a plurality of resilient fingers 40*a* engaging at a distal end portion of these fingers into a circumferential groove 42 of the male probe portion 36 (as is best seen in FIG. 4). This nut member 40 is effective to move the male probe portion 36 axially (i.e., into and from the female connector part 22) in response to rotation of the handnut member 34 (recalling arrow 34*a*), as will be explained below. The elbow and hose barb member 38 provides for connection of conduit 14 to the male probe portion 36, and also provides for the conduit to resist turning of this male probe portion as the actuator 34 is rotated to effect connecting or disconnecting of the connector parts 22 and 32, as will be seen.

As is seen in FIGS. 4, 5, and 6, (and viewing FIG. 4 in particular) both the manually rotational actuator portion 34 (i.e., the handnut 34) and the male connector portion 36 are movably carried on a guide portion 44 of the male connector part 32. This guide portion 44 rotationally carries the actuator member 34 for relative rotation, and carries the male probe portion 36 for relative axial movement. At its forward surface 44*a*, the guide portion 44 defines the stirrup 32*a* for mounting to the female connector part 22. As was pointed out above, this stirrup 32*a* provides for coaxial alignment of the male and female connector parts 32 and 22, and for relative axial immobilization of these connector parts. In other words, the stirrup 32*a* captures the flange 30, holds the connector parts 22 and 32 in axial alignment, and restricts relative axial movement of the connector parts 22 and 32 while the male probe portion enters and withdraws from the female connector part.

In the illustrated embodiment, the guide portion 44 includes a forward wall portion 44*b*, which defines the surface 44*a* and carries the crescent-shaped stirrup 32*a*. This stirrup 32*a* defines a radially inwardly opening groove 44*c* for laterally receiving the mounting flange of the female connector part 22. This particular mounting structure for mounting and relatively axially immobilizing a male connector part to and on a female connector part will be familiar from the '298 patent cited above, although the present invention is not so limited. It will be noted that the guide portion 44 defines a forward, centrally located opening 44*d*, through which the forward portion 36*a* of the male probe portion 36 extends in order to engage with the female connector part 22, viewing FIG. 4.

The male connector part 32 also includes mechanization for translating rotational relative motion of the handnut 34 into relative axial motion of the male probe portion 36. In order to provide for relative rotation of the handnut 34 on the guide portion 44, this guide portion defines a collar part 46 defining a radially inwardly disposed circumferential groove 48. A forward portion 34*b* of the actuator 34 defines a radially outwardly disposed circumferential rib 50. The rib 50 is rotationally captured in the groove 48, so that the actuator 34 is rotationally carried on the guide portion 44. The nut member 40 includes an annular portion 40*b*, from which axially extends the plurality of fingers 40*a*, and radially outwardly from which extends a diametrically opposed pair of angulated thread sections 52.

The actuator member 34 is rotationally carried by the guide member 44, and defines a radially inwardly disposed double-start female thread) 54. The thread sections 52 of the nut member 40 are threadably received into the thread 54 of the actuator 34. As is seen in the drawing figures, the actuator 34 is preferably provided with surface features (such as ribs, grooves, stippling, a raised diamond pattern, knurling, etcetera) which provide for more effective manual grasping of the actuator 34.

As is seen in FIG. 5, the male connector part 32 may be mounted to the female connector part 22, and the actuator member 34 may then be manually rotated relative to the guide portion 44 so that the male probe portion 36 is axially moved (i.e., by action of thread sections 52 in double-start female thread 54) from the first position seen in FIG. 5 toward and then to the second position seen in FIG. 6. The nut member 40 is thus moved axially of the male connector part, with the fingers 40*a* transferring axial force to the male probe portion 36. The result is that the male probe portion 36 moves axially relatively to the guide portion 44 (and relative to the female connector part 22) from the position seen in FIG. 5 to that position seen in FIG. 6.

It is noted in FIG. 6, that a sealing sleeve 58 carried on the male probe portion 36 includes an outwardly extending flange part 58*a*. This flange part 58*a* encounters the wall portion 44*b* of the guide portion 44 and is thus prevented from further forward axial motion as the male probe portion 36 advances into the female connector part 22. The result is that fluid flow ports 60 of the male probe portion 36 are uncovered. As the male probe portion 36 continues forwardly into the female connector part (considering the change in relative positions of component parts from FIG. 5 to FIG. 6), a head portion 62 of the male probe portion 36 encounters and is received into a recess 64 defined in plug member 26. The head portion 62 is a "snap" fit into the recess 64, so that the plug member 26 is retainingly but removably attached to the head portion 62. It will be noted viewing FIGS. 5 and 6, that the plug member 26 is integrally formed with a fitting member 30*a*, which integrally defined the flange 30, and also defines the end edge 22*c* and the passage 28. Thus, it is to be appreciated that the plug member 26 is integral with and is integrally connected to the fitting member 30*a*. That is, the fitting member 30*a* includes a diametrically opposite pair of bridge portions 30*b*, each of which is joined to the fitting member at a buttress portion 30*c*. The buttress portions 30*c* are each joined to a diametrically opposite edge of the plug member 26 by a pair of articulation arms 30*d*. Each of the articulation arms 30*d* includes a pair of integral "living" hinge features, indicated with the arrowed numerals 30*e*.

Thus, viewing FIG. 6, it is to be appreciated that even when the male probe portion 36 reaches its full forward motion and full insertion into the female connector part 22 with the ports 60 fully uncovered and the plug member 26 unseated from the passage 28, the plug member 26 nevertheless remains attached integrally to the fitting 30*a*, and cannot be lost into the container 12. Further, it is to be noted that the opening of the male connector part 32 is not dependent upon the male connector part being engaged with a female connector part 22. Thus, the actuator 34 may be manually rotated in the appropriate direction even though the male connector part 32 is not connected to a female connector part, with the result that the male probe portion 36 is extended forwardly of the guide member 44. In this position of the male probe portion 36, the ports 60 are uncovered by sliding of the sealing sleeve 58 rearwardly to uncover these ports.

However, as is seen in FIG. 6, when the male connector part 32 is mounted to a female connector part, and the handnut 34 is relatively rotated to advance the male probe portion 36, then this male probe portion at a head feature 70 thereof engages into the plug member 26 of the female connector part. This engagement of the head feature is effective with further forward movement of the male probe portion 36 (i.e., because of continued relative rotation of the handnut 34) to carry the plug member 26 inwardly of the bag 18, thus opening the flow passage 28.

It is to be noted that the pair of integral and diametrically opposed (i.e., in axial view) bridge portions members 30*b* always connect the plug member 26 and the female connector part 22 (that is, the fitting portion 30*a* of this female connector part 22). Stated again, it is to be recalled that the plug member 26 is an integral part of the female connector part 22, and remains connected to this female connector part at all times regardless of whether the plug member is sealingly engaged with (as shown in FIG. 5) or is disengaged from (as shown in FIG. 6) the passage 28 of the female connector part 22. The bridge portions 30*b* each include a pair of integral living hinge portions (indicated at arrowed numerals 30*e*) which allow the bridge portions 30*b* to flex controllably as the plug member 26 is moved axially with probe portion 36 between the positions seen in FIGS. 5 and 6. Importantly, because of the connection by bridge portions 30*b* to the fitting 30*a*, the plug member 26 can never become disconnected from the female connector part 22 to become lost within the container 12.

It will be understood that relative rotation of the actuator 34 in the opposite direction is effective to return the male and female connector parts from their positions seen in FIG. 6 to the relative positions of FIG. 5. As the male probe portion 36 is withdrawn from the female connector part 22, a spring 58*b* is effective to move sleeve 58 once again across the ports 60, closing the flow path 36' in male probe portion 36. Once the male probe portion 36 is withdrawn from within the female connector part 22, the male connector part 32 can be moved laterally to dismount from the female connector part at flange 30 (i.e., removing the mounting flange 30 from within the crescent stirrup 32*a*—recalling the description above of FIG. 4).

Figure 7:
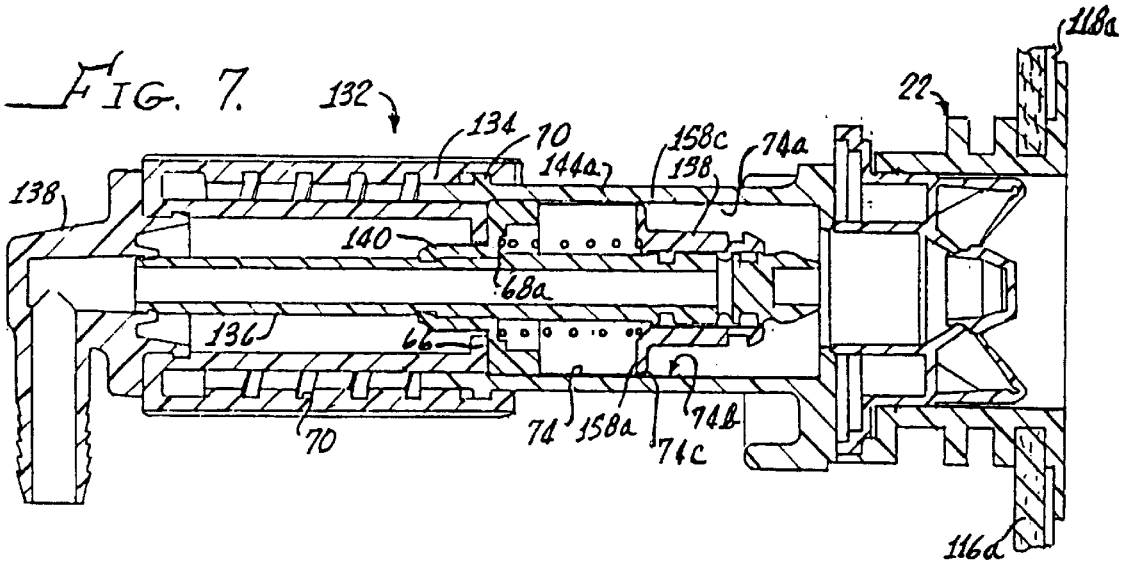
FIG. 7 is similar to FIG. 5, and illustrates an alternative embodiment of a male connector part mounted to but not engaged with a female connector part.
Figure 8:
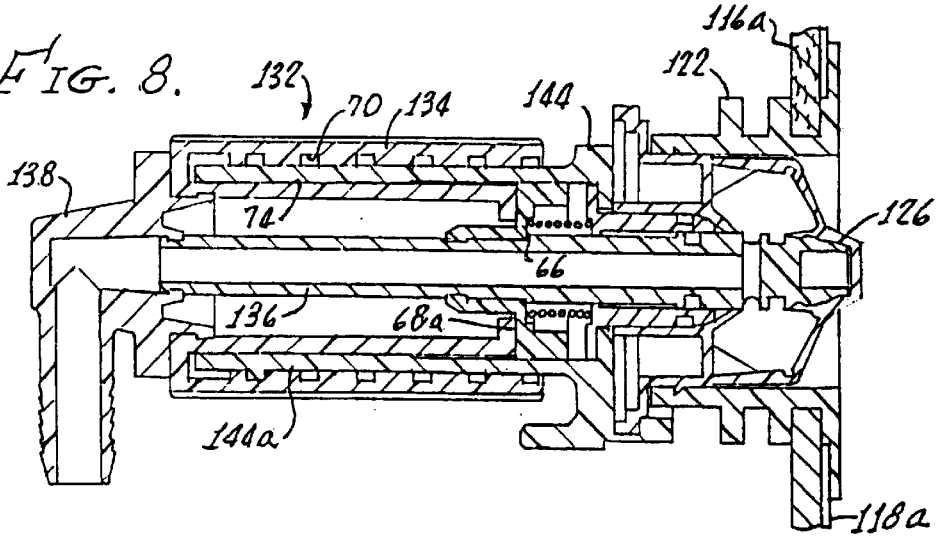
FIG. 8 is similar to FIG. 6, and illustrates the alternative embodiment of the male connector part coupled to a female connector part so that both the male and female connector parts are opened and fluid may flow between these connector part.

FIGS. 7, and 8 depict a second embodiment of the invention. In order to provide reference numerals for use in describing this alternative embodiment of the invention, features which are the same as (or which are analogous in structure or function to) those features depicted and described above, are referenced in FIGS. 7 and 8 with the same numeral used above, and increased by one-hundred (100). As can be seen it FIGS. 7 and 8, in this embodiment, the rotary handnut 134 is not axially relatively immovable on a guide member of the male connector part while being manually rotated, as was the handnut 34 in the first embodiment. Rather, as this handnut 134 is rotated it also moves axially forward or backward along the guide portion 144 (i.e., depending of the direction of relative rotation). As the handnut 134 is moved rotationally and axially it effects simultaneous axial movement of a cup member 140 and of the male probe portion 136 by cooperation of the cup member 140 which a pair of radially outwardly disposed keys 66. The handnut 134 includes an inner tubular portion 68 which at its inner distal end defines an axially disposed thrust surface 68*a*. This thrust surface 68*a* engages the cup member 140 to move this member axially rightwardly, viewing FIGS. 7 and 8, in response to rightward axial movement of the handnut 134. This relationship of the cup member 140 and the inner tubular portion 68 of actuator 134 allows the cup member to not rotate as actuator 134 is manually rotated, and to transfer axial forces to the male probe portion 136. On the other hand, when the handnut 134 is manually rotated in the opposite direction, and moves in the opposite axial direction along the guide member 144, the handnut applies an opposite axial force to the male probe portion via an axially disposed thrust surface 134*c*. This thrust surface 134*c* bears against the elbow and hose barb member 138 to move the male probe member 136 in the opposite axial direction relative to the guide member 144.

In this embodiment, the guide portion 144 includes a tubular extension 144*a* with a radially outwardly disposed thread 70. The actuator portion 134 defines a matching female thread 72, which threadably engages onto the thread 70. Also in this embodiment, the tubular extension 144*a* defines a stepped bore 74, having a slightly larger diameter bore portion (indicated by arrowed numeral 74*a*. The sealing sleeve 158 is provided with a radially outwardly extending, somewhat flexible web part 158*c* (i.e., an outer portion of flange 158*a*), which web part is flexible enough to pass through the smaller diameter portion of bore 74, and into the bore portion 74*a*. There in the larger diameter bore portion 74*a*, the somewhat flexible web part 158*c* resists axial withdrawal from this bore portion. Thus, when the actuator 134 is manually turned from the position seen in FIG. 8 and toward the position seen in FIG. 7, the user experiences a "stop" in the free movement of the actuator when the web part 158*c* engages an axially disposed step 74*b* presented at the end of bore portion 74*a*.

Of course, should the user wish to disassemble the connector part 132, then continued forceful turning of the actuator 134 in the same direction (i.e., in the direction necessary to move the handnut member 134 from the position of FIG. 8 toward that of FIG. 7) will force the flexible web 158*c* past this step 74*b*, and allow the actuator 134 to be unthreaded completely from the guide portion 144. Once the actuator 134 is unthreaded from the guide portion 144, the male probe portion 136 can be manually withdrawn from within the guide portion for inspection and cleaning.

Each of the alternative embodiments of the present invention offer the advantage of making the female connector part of such low cost that it may be thrown away with the disposable bag-in-box container 12, or with another type of non-recyclable container. Alternately when used with a recyclable container, such as are those made of glass or durable plastic, then when the container is cleaned the female connector part 22 may be disposed of and a new one inserted in its place. The male connector part 32, 132 may be taken apart for cleaning and is thus durable and reusable over a period of time with several different female connector parts 22 on successive containers 12.

While the present invention has been depicted, described, and is defined by reference to two exemplary and particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. For example, the present connector parts can be used with fluids other than food products. These present inventive connector parts could be used with various liquids, such as chemicals. Photographic chemicals are an example of a liquid other than a food product with which the present connector parts could be used. Also, the present connector parts according to this invention can be used with other types of vessels and containers in addition to those depicted, described, or referred to specifically herein. For example, bag type vessels can be used with the present connector parts even if the bag is not disposed in a box. The present connector parts have a special advantage is such a use because the male and female connector parts can be engaged with one another in response to a lateral relative movement and with little applied force. Thereafter, connector of the male and female connector parts requires the application of manual rotating forces of rather a low level. In other words, even those individuals of rather low hand strength will be able to apply sufficient relative twisting force to the male connector part of the present invention so that engagement and disengagement of this male connector part is easily accomplished. Consequently, an ease of use of a male and female connector parts, which was not heretofore achievable, is provided by the present invention. The present connector parts can also be used to effect fluid communication between a pair of conduits or a pair of vessels, for example, instead of just between a vessel and a conduit as depicted. Thus, it is appreciated that the depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. A male connector portion for use with a female connector portion to form a fluid-flow connection, each of said male connector portion and the female connector portion defining a respective axially extending fluid flow path and being removably engageable with one another to communicate the respective fluid flow paths, said female connector portion including an integral valve element having a closed first position closing the fluid flow path of the female connector portion and an open second position axially displaced from said first position, said valve element moving to said second position in response to engagement together of said connector portions to communicate said fluid flow paths with one another and remaining integrally connected with said female connector portion in both said first and said second positions thereof, said male connector portion comprising:

a male probe portion reciprocable axially relative to a remainder of said male connector portion;

a guide portion including support means for supportingly and releasably engaging onto the female connector portion, said guide portion including structure for carrying a rotatable actuator member relative rotation of which effects reciprocation of said male probe portion between first and second positions to respectively connect and disconnect of the male probe portion into and from the female connector portion; and said actuator member and said male probe portion defining cooperating structure for reciprocating said male probe portion axially between said first position and said second position in response to relative rotation of said actuator member;

said male probe portion in response to reciprocation to its second position moving said valve member to its respective second position.

2. The male connector portion of claim 1 wherein said guide portion includes a tubular portion.

3. The male connector portion of claim 2 wherein said tubular portion defines a stepped bore having a larger diameter section presenting an axially disposed step on said bore.

4. The male connector portion of claim 2 wherein said actuator portion carries a radially outwardly extending protrusion, and said guide portion carries a radially inwardly extending yieldable catch protrusion, so that in said second position of said male probe member, said catch protrusion captures said protrusion of said actuator portion to prevent inadvertent closing of the male connector part.

5. The male connector portion of claim 2 further including said male probe portion carrying a sealing sleeve member reciprocating with said male probe portion, said sealing sleeve member including a radially extending flange with a radially outer semi-flexible web section extending radially outwardly into said larger diameter bore section, and said web section substantially preventing withdrawal of said male probe portion from within said tubular section.

6. The male connector portion of claim 1 wherein said cooperating structure of said actuator and said male probe portion includes said male probe portion carrying a nut member reciprocating in unison with said male probe member, said nut member including a radially outwardly disposed thread section, and said actuator member disposing a radially inwardly disposed thread section threadably engaging with the thread section of said nut member.

7. The male connector portion of claim 6 wherein said nut member includes a pair of diametrically opposite protrusions, each of said pair of protrusions defining a respective one of a pair of interrupted diametrically opposite male thread sections, and said actuator member includes a double-start thread engaging each of said pair of interrupted diametrically opposite thread sections.

8. The male connector portion of claim 1 wherein said guide portion and said actuator member further define cooperating structure for allowing relative rotation of said actuator member while preventing axial relative movement.

9. The male connector portion of claim 8 wherein said cooperating structure of said guide portion and said actuator includes said guide portion defining a radially and circumferentially extending groove, said actuator including a radially and circumferentially extending rib received rotationally into said groove and preventing axial relative movement of said actuator on said guide portion.

10. The male connector portion of claim 9 wherein said guide portion includes a collar portion cooperating with a remainder of said guide portion to define a radially inwardly opening and circumferentially extending groove, said actuator member rib being movably received into said circumferentially extending groove of said collar portion.

11. The male connector portion of claim 1 wherein said male connector portion includes a respective valve element, said respective valve element including a sealing sleeve member slidably carried on said male probe portion, said male probe portion defining an aperture opening laterally outwardly thereon from said axially extending fluid flow path, and said sealing sleeve member in a closed first position spanning and closing said aperture, said sealing sleeve member including a radially outwardly extending element engageable with said female coupling portion upon forward reciprocation of said male probe portion to stop further forward motion of said sealing sleeve member so that said male probe portion continues forward toward and into said female connector portion to uncover said aperture.

12. A method of effecting and controlling fluid flow communication between a pair of flow paths, and of isolating the flow paths from ambient when not in communication with one another, said method comprising steps of:

providing a female connector part having an axially extending fluid flow path, and an integral plug member in a closed first position spanning and closing this flow path, and providing for said plug member to move axially to an opened second position while remaining integral with said female connector part;

providing a male connector part having an axially extending fluid flow path, and engaging said male connector part onto said female connector part with said fluid flow paths in axial alignment;

providing said male connector part with a guide member engageable in response to lateral relative movement onto said female connector part with said axially extending fluid flow paths axially aligned;

providing a male probe portion defining said fluid flow path of said male connector part and reciprocable relative to said guide member; forming a port opening laterally from said flow path on said male probe portion, and disposing a respective axially movable tubular valve member in a first position spanning and closing said port to close communication with ambient, and in a second position axially displaced from said first position utilizing said tubular valve member to uncover said port and open communication between the fluid flow paths of the engaged connector structures;

providing an actuator rotationally carried upon said guide member, defining in cooperation between said actuator and said male probe portion a cooperating structure for reciprocating said male probe portion between its said first position and its said second position in response to rotation of said actuator relative to said guide member; and engaging said male and said female connector parts, and relatively rotating said actuator to effect reciprocation of said male probe portion so that communication of said fluid flow paths is opened and closed.

13. A two-part fluid connector structure having a female connector part for fluid-flow communication with a vessel, and a male connector part for fluid-flow communication with a conduit, said connector parts being mutually engageable to effect fluid-flow communication between said vessel and said conduit, and being disengageable to both discontinue said fluid-flow communication and also to mutually close fluid-flow communication between ambient and each of said vessel and conduit; said two-part connector structure comprising:

said female connector part having:

a female cap member defining an axially extending through passage communicating between ambient and said vessel, said cap member defining an axially disposed end edge surface about said through passage;

a plug member integrally formed with said cap member and in a closed first position spanning and closing said through passage of said cap member, said plug member being movable axially to a opened second position opening said through passage to said vessel while remaining integral with said cap member, said plug member defining an axially extending recess disposed outwardly of said through passage;

said male connector part having:

an elongate probe member defining a blind axial passage for fluid-flow communication with said conduit, a lateral aperture adjacent to a forward end of said probe member and opening outwardly from said axial passage on said probe member, and a head portion adjacent to a forward end of said probe member for engaging into said recess of said plug member, a sleeve valve member carried slidably on said probe member between a first position across and closing said lateral aperture and a second position at least partially rearwardly of said opening of said lateral aperture, said sleeve valve reciprocating in unison with said probe member and having a radially outwardly extending flange portion at a rear end thereof, and said flange portion being engageable with said end edge surface of said cap member to stop forward reciprocation of said sleeve valve member so that said sleeve valve member is relatively moved to said second position thereof as said probe member continues in reciprocation into said cap member;

a guide structure reciprocably carrying said probe member and said sleeve member, said guide structure including a forward flange portion having a central opening therein, and means for engaging supportingly upon said cap member with said central opening in alignment with said through passage of said cap member, means for defining a guide way for said probe member and sleeve valve member to allow reciprocation thereof via said central opening into and from said through passage of said female connector part; and an actuator rotationally carried upon said guide member and defining with said male probe member cooperating structure for reciprocating said male probe portion relative to said guide member between its said first position and its said second position in response to rotation of said actuator relative to said guide member.

* * * * *